US005201445A

United States Patent [19]

Axelman

[11] Patent Number: 5,201,445

[45] Date of Patent: Apr. 13, 1993

[54] TOOL HOLDER WITH SELF-STABILIZING SWIVEL MOUNT

[76] Inventor: Bart I. Axelman, 23 Russell St., Winooski, Vt. 05404

[21] Appl. No.: 703,173

[22] Filed: May 20, 1991

[51] Int. Cl.[5] ..... A45F 5/00

[52] U.S. Cl. ..... 224/197; 224/251; 224/253; 224/271; 224/904; 248/214; 248/222.1

[58] Field of Search ..... 224/197, 200, 253, 271, 224/904, 251; 211/70.6; 248/214, 222.1, 632, 224.4, 223.4, 224.1, 224.3; 24/3 E, 3 F, 609, 684; 81/180.1, DIG. 1, 57.4

[56] References Cited

U.S. PATENT DOCUMENTS 1,409,971 3/1922 Riedesel ..... 81/DIG. 1
2,764,326 9/1956 Stanton .
2,830,478 4/1958 Prince ..... 81/180.1
2,958,448 11/1960 Leclerc .
3,743,147 7/1973 Wilczynski .
4,372,468 2/1983 Harvey ..... 224/268
4,662,552 5/1987 Vyehara ..... 224/253
4,677,362 6/1987 House, II et al. ..... 224/904
4,828,154 5/1989 Clifton ..... 224/253
4,917,281 4/1990 Ostermiller ..... 224/253
4,936,499 6/1990 Gulley ..... 224/252

*Primary Examiner*—Linda J. Sholl
*Attorney, Agent, or Firm*—Natter & Natter

[57] ABSTRACT

A tool holder has a self-stabilizing swivel mount for selectively accommodating an air driven hand-held power tool. An article receptacle is rotatably displaceable upon weight transference from the tool and is adapted to assume an equilibrium rest position. A gravity actuated locking lug coacts with the receptacle for securing the tool within the receptacle. The locking lug is self releasing when the receptacle is re-oriented to a substantially vertical position for removal of the power tool.

13 Claims, 2 Drawing Sheets

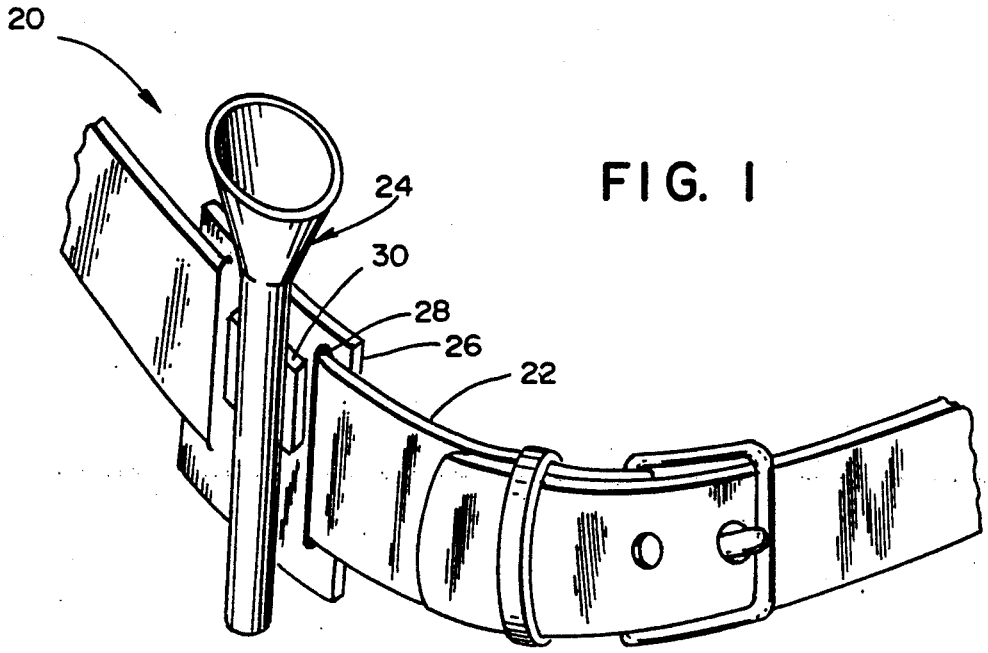
FIG. 1
FIG. 4
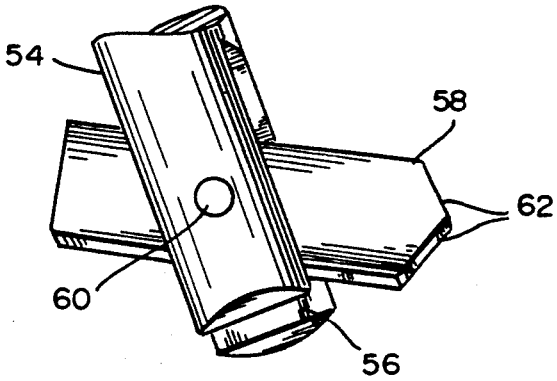
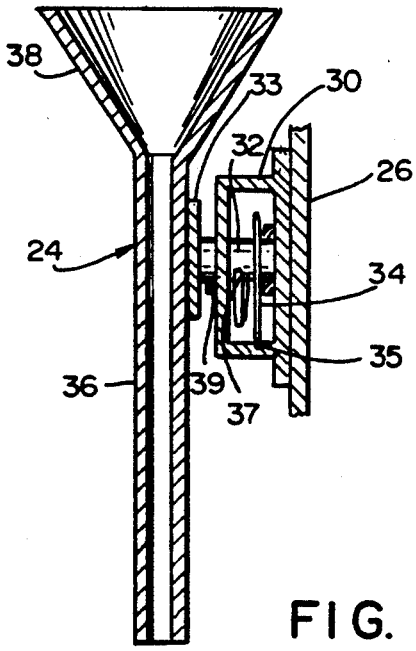
FIG. 2
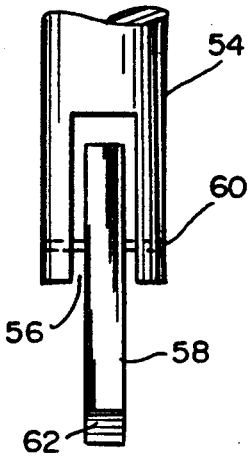
FIG. 5

TOOL HOLDER WITH SELF-STABILIZING SWIVEL MOUNT

1. Field of Invention

This invention relates generally to article carriers and especially to a tool holder supported by a waist-belt.

In particular, the device in this invention concerns a tool holder having a self-stabilizing swivel mounted article receiver for carrying pneumatically operated hand-held power tools.

2. Background Art

Air driven power tools and particularly hand-held fastener guns such as stapler guns and nail guns provide increased productivity in a variety of industrial applications. These power fasteners are generally larger in size and heavier in weight than conventional hand tools. For example, a typical stapler or nail gun can weigh approximately 5 to 12 lbs. is about 10" to 17" in heighth and length and 3" to 4" in width. The specifications will however, vary depending on the manufacturer, style of gun and model no. Additionally, these power tools are magazine fed using air as the driving force and must be connected by a hose to an air compressor.

Conventional tool holders are not adapted to support these rather bulky pneumatic tools that create an unbalanced weight distribution when suspended. This problem is also due in part to the "drag" produced by the air hose. A typical belt-attached tool holder, such as illustrated in U.S. Pat. No. 4,936,499, is unsuitable for holding such power tools since it cannot readily accommodate an asymmetric load.

The tool holder shown in U.S. Pat. No. 4,372,468 provides a restricted swivel action that is not sufficient to transfer the load to an equilibrium position. Similarly, the tool support described in U.S. Pat. No. 3,743,147 has like deficiencies.

BRIEF DESCRIPTION OF THE INVENTION

Briefly, the nature of this invention involves a tool holder for hand-held air driven power tools. The holder has a swivel mounted article receptacle to compensate for torque forces generated by the center of gravity of the tool when suspended and the tension of the air hose acting on the power tool.

The article receptacle is adapted to selectively accommodate a hook member extending from the tool. The receptacle is further rotationally displaceable upon weight transference for equalizing the unbalanced force vectors. The hook member is retained within the receptacle by a locking arrangement at a distal end of a leg of the hook. The locking arrangement includes a gravity actuated swingable lug that is displaceable to a locked mode to prevent unintentional disengagement of the tool. When the receptacle is returned to an initial substantially vertical hook entry/exit position, the locking lug releases the hook member for slidable removal of the tool.

The swivel mounting for the receptacle includes a spring mechanism for biasing the receptacle to the substantially vertical entry position upon removal of the tool.

A feature of this invention is that the power tool can be seated in the tool holder without first releasing the tool during temporary work stoppage and can be removed from the tool holder with one hand. The operator should readily sense the location of the tool holder and easily maneuver the power tool into docking engagement with the receptacle utilizing the hook member and without the necessity for visual sighting. To further facilitate this procedure, the entranceway of the receptacle includes a flared opening. An advantage therefore of this device is that it provides hand motion efficiency.

In view of the foregoing, it should be apparent that the present invention overcomes many of the deficiencies of the prior art and provides an improved tool holder.

Having thus summarized the invention, it will be seen that it is an object thereof to provide a tool holder of the general character described herein which is not subject to the aforementioned shortcomings.

Another object of this invention is to provide a tool holder having a self-stabilizing swivel mount for positioning the tool in an equilibrium rest position.

A further object of this invention is to provide a tool holder suitable for accommodating an air driven hand-held power tool tethered to an air hose.

Still another object of this invention is to provide a tool holder providing a gravity locking arrangement that coacts with the receptacle for securing the tool within the holder and is self-releasing for removal of the tool.

A still further object of this invention is to provide a tool holder that is fully functional without operator hand-manipulation.

Yet another object of this invention is to provide a tool holder that is simple in construction, reliable in use and well adapted for mass production fabrication techniques.

Other objects of this invention will in part be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown an exemplary embodiment of the invention:

FIG. 1 is a perspective view showing a tool holder with a self-stabilizing swivel mount attached to a waist belt and slidably positionable on a belt pad;

FIG. 2 is a sectional view illustrating a tubular article receptacle affixed to a spring-loaded pivot housing;

FIG. 4 is an enlarged perspective of a free leg of the hook member showing a bifurcated distal end having a swingable locking lug;

FIG. 5 is a perspective view of the bifurcated distal end of the free leg of FIG. 4, showing the locking lug in coincident alignment with the longitudinal axis of the leg.

DETAILED DESCRIPTION OF THE INVENTION

Figure 3:
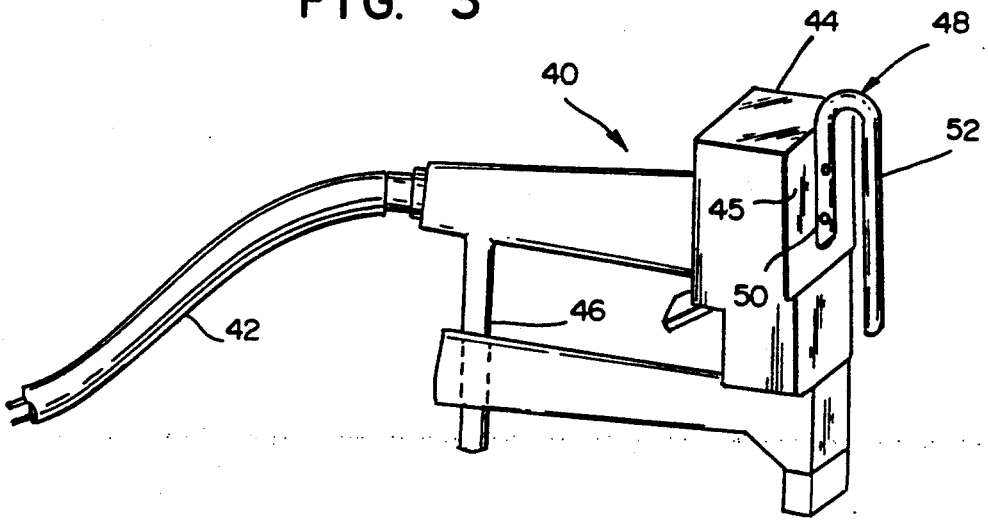
FIG. 3 is a perspective view of an air driven hand-held power tool having a tethered air hose and a hook member affixed to the tool.

Referring now in detail to the drawings, the reference numeral 20 denotes generally a tool holder in accordance with this invention.

The exemplary embodiment as shown in FIG. 1 is adapted for attachment to a belt 22 which can be worn by the power tool operator. It should be understood however, that the tool holder 20 can be connected to other torso-encircling support devices or for example, to a portable stand.

With regard to this preferred embodiment, an article receptacle 24 is swivel mounted by a pivotal connection to a belt pad 26 of pliant material, such as leather. The pad 26 is provided with slots 28 for providing adjustable securement of the pad 26 to the operator's waist belt 22. The pad 26 can be positioned along the belt 22 to a comfortable and convenient location, for example overlying the operator's hip.

A pivot housing 30 is secured to the pad 26 and includes a pin 32 journaled within the housing 30 and attached at one end to a boss 33 on the receptacle 24. The pin 32 is resiliently urged by a spring member 34 such as a coil spring. The spring 34 defines an extension 35 which abuts against an interior wall of the pivot housing 30; an opposite end 37 of the spring 34 is anchored to the pin 32 and a limit stop 39 defines the extent of rotation. Thus, the pin 32 will yieldably rotate the receptacle 24 to a substantially vertical position as shown in FIGS. 1 and 2.

Referring once again to the receptacle 24, a lower portion thereof is comprised of a substantially tubular member 36; an upper portion of the receptacle 24 is flared outwardly to form a funnel shaped configuration 38 as shown in FIG. 2.

Referring now to FIG. 3, there is shown a typical air driven hand-held power tool 40 having a tethered air hose 42, a head 44 and a hand grip 46.

A hook member 48 is shown as a U-shaped member having a fixed leg 52 secured to the head 44 and a free leg 52 offset from a surface 45 of the head 44 and extending substantially parallel thereto. The leg 52 has a thickness dimension which is less than the diameter of the tubular section 36 to provide sufficient tolerance for slidable passage therethrough. The length dimension of the leg 52 is greater than the length dimension of the receptacle 24 such that a distal end 54 will extend from the receptacle 24 when the hook member 48 is fully seated.

Figure 6:
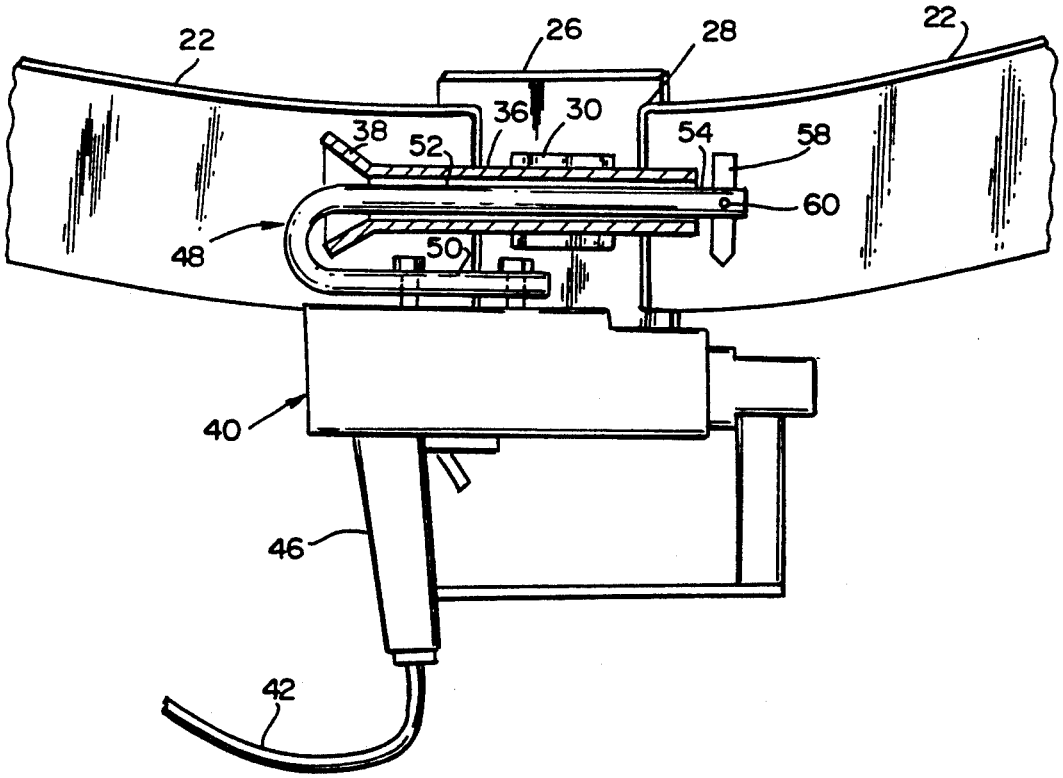
FIG. 6 is a perspective view, in partial section illustrating the equilibrium rest position of the power tool and the locking lug securing the tool within the receptacle.

A gravity actuated locking mechanism for securing the hook member 48 and attached tool 40 within the receptacle 24 is shown in FIGS. 4 and 5. The distal end 54 is bifurcated to provide a channel 56 adapted for receiving a locking lug 58. The locking lug 58 is swingably connected by a transverse pin 60. A lower end of the locking lug 58 extends beyond the distal end 54 as shown in FIG. 5 and further is provided with two sloped surfaces 62. It should be further noted that the locking lug 58 is not centered about the transverse pin 60 such that an unbalanced weight distribution occurs upon rotation of the receptacle 24 as shown in FIG. 6 and the locking lug 58 will be gravitationally rotated to a transverse position. The length of the lug 58 is greater than the diameter of the tubular member 36, thereby securing the leg 52 within the receptacle 24.

It should be observed that although the pivot housing 30 has been described with reference to a spring 34 for biasing the receptacle 24 to a substantially vertical position, an alternate structure can be provided without the spring 34. For example, the receptacle 34 can be sufficiently weighted so that it will assume by gravitational influence, the substantially vertical hook entry/exit position.

In use, the tool holder 20 is positioned on the belt 22 for the convenience of the operator. When it is desired to temporary discontinue using the tool 44, the leg 52 is registered with the flared opening 38 which guidingly positions the leg 52 for entry into the tubular member 36. The sloped surfaces 62 of the locking lug 58 further aid in effecting a slidable entry. In this regard it is anticipated that the operator will not need to release the hand grip 46 or require visual observation to locate the opening 38.

The weight distribution of the tool 44 and the "drag" of the air hose will rotate the tool 44, in opposition to the force exerted by the spring 24, into a substantially horizontal equilibrium position as shown in FIG. 6. The locking lug 58 will automatically swing into a transverse operative mode with respect to the longitudinal axis of the leg 52 as shown in FIG. 6 to secure the hook member 48 and attached tool 44 within the receptacle 24.

When it is desired to remove the tool 44, the receptacle 24 is rotated, by the handle 46, in a continuous hand motion to a substantially vertical position. The locking lug 58 will thus be rotational displaced in the channel 56 for alignment with the longitudinal axis of the leg 52 to provide clearance within the tubular member 36 and the attached tool 44 can be withdrawn from the receptacle 24.

It should thus be seen that there is provided a tool holder which achieves the various objects of this invention and which is well adapted to meet conditions of practicable use.

Since various possible embodiments might be made to the present invention or modifications might be made to the exemplary embodiments set forth, it is to be understood that all materials shown and described in the accompanying drawings are to be considered as illustrative and not in a limiting sense.

Having thus described the invention, there is claimed as new and desired to be secured by Letters Patent:

1. A tool holder adapted to support a hand-held air driven power tool comprising receptacle means for accommodating the tool, pivot means for rotatably displacing the receptacle means, hook means attachable to the tool for engaging the receptacle means to suspend the tool therefrom, said tool being swingable about the pivot means to a weight stabilized equilibrium position, locking means for securing the hook means to the receptacle means when the tool is in the equilibrium position, said hook means including a leg member spaced from a surface of the tool and extending substantially parallel to said surface, said locking means including a rotatable locking lug within the leg member, said locking lug providing the securement of the leg member within the receptacle means.

2. A tool holder as claimed in claim 1 wherein the receptacle means comprises a tubular member open at both ends.

3. A tool holder as claimed in claim 2 wherein one end of the tubular member defines a flared entrance for guidingly accommodating the hook means.

4. A tool holder as claimed in claim 1 wherein the pivot means urges the receptacle means to a substantially vertical position.

5. A tool holder as claimed in claim 4 wherein the pivot means includes a spring member for resiliently urging the receptacle means to the substantially vertical position.

6. A tool holder as claimed in claim 2 wherein the leg member extends beyond said receptacle means, said locking lug further being gravitationally displaceable into a transverse operative mode with respect to the longitudinal axis of the leg member during rotation to the equilibrium position.

7. A tool holder as claimed in claim 6 wherein the length dimension the locking lug is greater than the diameter of the tubular member to prevent removal of the leg member when the receptacle means is in the equilibrium position.

8. A tool holder as claimed in claim 7 wherein the locking lug is pin connected to a distal end of the leg member, said locking lug further being alignable with the longitudinal axis of the leg member for withdrawal of the hook means.

9. A tool holder as claimed in claim 1 wherein the pivot means is securable to a waist-belt.

10. A tool holder with self-stabilizing swivel mount for carrying a hand-held power tool, comprising receptacle means adapted for supporting the tool, hook means selectively engageable with the receptacle means for suspending the tool therefrom, said receptacle means being secured to a swivel mounting, said tool being freely swingable about the swivel mounting to a weight stabilized equilibrium position with respect to the swivel mounting, said hook means further including a leg member extending from the tool, locking means for securing the leg member within the receptacle means, said locking means including a locking lug at a distal end of the leg member, said locking lug being alignable coincidentally with respect to a longitudinal axis of the leg member during engagement with the receptacle means and being actuatable when the tool is displaced to the equilibrium position.

11. A tool holder with self-stabilizing swivel mount as claimed in claim 10, wherein the locking means is gravity actuated when the tool is in the equilibrium position.

12. A tool holder with self-stabilized swivel mount as claimed in claim 11, wherein the swivel mounting includes resilient means for urging the receptacle means to a tool receiving position.

13. A tool holder with self-stabilizing swivel mount as claimed in claim 10, wherein the locking lug is displaceable transversely with respect to the longitudinal axis of the leg member for securing the leg member within the receptacle.

* * * * *